United States Patent [19]

Okano et al.

[11] Patent Number: 4,933,863

[45] Date of Patent: Jun. 12, 1990

[54] CONTROL SYSTEMS FOR INTERNAL COMBUSTION ENGINES

[75] Inventors: Takayuki Okano; Yukio Masuda, both of Hiroshima, Japan

[73] Assignee: Mazda Motor Corporation, Hiroshima, Japan

[21] Appl. No.: 199,993

[22] Filed: May 26, 1988

[30] Foreign Application Priority Data

May 30, 1987 [JP] Japan ..... 62-135935

[51] Int. Cl.[5] ..... F02D 41/22; F02D 41/16

[52] U.S. Cl. ..... 364/431.07; 364/431.05; 364/431.06; 364/431.11; 123/479; 123/480; 123/489

[58] Field of Search ..... 364/431.04, 431.07, 364/431.1, 431.11, 431.05, 431.06; 123/339, 349, 479, 393, 489, 440, 480

[56] References Cited

U.S. PATENT DOCUMENTS

| | | | |
|---|---|---|---|
| 3,938,075 | 2/1976 | Reddy | 123/479 |
| 4,457,275 | 7/1984 | Hosokai et al. . | |
| 4,457,276 | 7/1984 | Ueda et al. . | |
| 4,488,525 | 12/1984 | Isutsumi et al. . | |
| 4,562,808 | 1/1986 | Tominaga et al. . | |
| 4,589,390 | 5/1986 | Wasaki et al. | 123/489 |
| 4,677,955 | 7/1987 | Takao | 123/489 |
| 4,681,075 | 7/1987 | Yamato et al. | 123/339 |
| 4,691,675 | 9/1987 | Iwaki et al. . | |
| 4,702,210 | 10/1987 | Yasuoka et al. | 123/339 |
| 4,708,109 | 11/1987 | Takao | 123/339 |
| 4,716,871 | 1/1988 | Sakamoto et al. . | |
| 4,747,379 | 5/1988 | Oba | 364/431.07 |

FOREIGN PATENT DOCUMENTS 56-44431 1/1981 Japan .

*Primary Examiner*—Felix D. Gruber
*Assistant Examiner*—V. Trans
*Attorney, Agent, or Firm*—Sixbey, Friedman, Leedom & Ferguson

[57] ABSTRACT

A control system for an internal combustion engine comprises an engine speed sensor, a section for producing a feedback correction value in accordance with a difference between speed of the engine detected by the engine speed sensor and a target idling speed when the engine is in a specific idle operation, a section for producing a learning control correction value based on the feedback correction value and storing the produced learning control correction value in a memory to renew a stored learning control correction value, a section for the performing a feedback control for the speed of the engine with the feedback correction value and the learning control correction value combined with a fundamental control value to keep an actual idling speed of the engine at the target idling speed, an air-fuel ratio sensor, a section for performing a feedback control for an air-fuel ratio of a fuel mixture in accordance with an detection output of the air-fuel ratio sensor, a section for detecting malfunction of the air-fuel ratio sensor, and a section for prohibiting the production of a new learning control correction value when the malfunction of the air-fuel ratio sensor is detected.

12 Claims, 5 Drawing Sheets

CONTROL SYSTEMS FOR INTERNAL COMBUSTION ENGINES

BACKGROUND OF THE INVENTION

1. Field of the Invention

The present invention relates generally to control systems for internal combustion engines, and more particularly, to a system for controlling idling speed of an internal combustion engine and an air-fuel ratio of a fuel mixture in the internal combustion engine, by which an actual idling speed of the internal combustion engine is controlled to be kept at a predetermined target idling speed and the air-fuel ratio of the fuel mixture is controlled to be of a value in a relatively narrow range including a predetermined value.

2. Description of the Prior Art

There has been proposed an internal combustion engine used for an automobile equipped with an idling speed control system by which a feedback control for intake air mass flow is carried out for controlling the opening degree of an air flow adjusting valve which is disposed in a bypass provided to an inlet passage of the engine for detouring a throttle valve provided therein or for controlling the opening degree of the throttle valve which is opened by an actuator to vary the intake air mass flow supplied to the engine in such a manner that idling speed of the engine is kept at a predetermined target idling speed. It has been also proposed to provide the feedback control for intake air mass flow with a learning function in determination of a feedback control value, as disclosed in, for example, the Japanese patent application published before examination under publication No. 56-44431.

In the idling speed control system by which the feedback control for intake air mass flow is carried out and a learning operation is performed for determining a feedback control value under that feedback control, a feedback correction value is produced in accordance with a difference between an actual idling speed of an engine and the target idling speed and then a learning control correction value is calculated based on the feedback correction value in addition to a fundamental control value used for controlling the intake air mass flow. Each learning control correction value is stored in a memory and renewed in the memory whenever a new one is obtained. The feedback control for intake air mass flow is performed with the fundamental control value, the feedback correction value and the learning control correction value, so that the actual idling speed of the engine is kept at a predetermined target idling speed.

In an internal combustion engine in which the feedback control for intake air mass flow is performed with the fundamental control value, the feedback correction value and the learning control correction value as mentioned above, an actual idling speed of the engine is caused to coincide expeditiously with a target idling speed at the beginning of the control without being easily influenced by secular change or variations in the characteristic of the engine, compared with another internal combustion engine in which the feedback control for intake air mass flow is performed with only the fundamental control value and the feedback correction value.

Then, it has been further proposed to make the internal combustion engine in which the idling speed control is performed as described above be equipped with an air-fuel ratio control system by which an air-fuel ratio of a fuel mixture provided for combustion in the engine is subjected to a feedback control so as to be of a value in a relatively narrow range including a predetermined value. The feedback control for the air-fuel ratio of the fuel mixture is performed to vary quantity of fuel actually supplied to a combustion chamber of the engine in accordance with a fundamental control value and a feedback correction value obtained based on the output of an air-fuel ratio sensor, such as an oxygen sensor disposed in an exhaust passage of the engine.

In the internal combustion engine wherein the feedback control for the air-fuel ratio of the fuel mixture is carried out in addition to the feedback control for intake air mass flow which is performed with the fundamental control value, the feedback correction value and the learning control correction value as described above, when the air-fuel ratio sensor comes to be in malfunction due to breaking of wire, short-circuit or other cause so that the output of the air-fuel sensor does not represent exactly the air-fuel ratio of the fuel mixture provided actually for combustion, the feedback correction value used in the feedback control for air-fuel ratio is not obtained properly and therefore it is feared that the fuel actually supplied to the combustion chamber is increased or decreased excessively. In the case where the fuel actually supplied to the combustion chamber is increased or decreased excessively in the idle operation of the engine, the actual idling speed of the engine becomes higher or lower than the target idling speed to vary the feedback correction value used in the feedback control for intake air mass flow by a relatively large margin and the feedback control for intake air mass flow is conducted to cause the actual idling speed to decrease or increase to the target idling speed with the feedback correction value which is apart from a normal range thereof.

When the feedback correction value used in the feedback control for intake air mass flow is varied in the above mentioned manner owing to the malfunction of the air-fuel ratio sensor, the learning control correction value which is set based on the feedback value is apart from an appropriate range thereof. Therefore, after the air-fuel ratio sensor recovers to operate properly, the feedback control for intake air mass flow is carried out with the learning control correction value stored in the memory under a condition wherein the air-fuel sensor is in malfunction and consequently a relatively long time is necessitated to cause the actual idling speed to coincide with the target idling speed.

The above described troubles or disadvantages arise similarly in an internal combustion engine in which the speed thereof is varied through a feedback control for ignition timing or the air-fuel ratio of a fuel mixture provided for combustion therein is controlled through a feedback control for intake air mass flow.

OBJECTS AND SUMMARY OF THE INVENTION

Accordingly, it is an object of the present invention to provide a control system for an internal combustion engine in which a feedback control for a controllable factor to vary speed of the engine and a feedback control for an air-fuel ratio of a fuel mixture in the engine are carried out respectively, and which avoids the aforementioned problems and disadvantages encountered with the prior art.

Another object of the present invention is to provide a control system for an internal combustion engine in which a feedback control for a controllable factor to vary speed of the engine is performed with a fundamental control value, feedback correction value and learning control correction value set based on the feedback correction value for keeping an actual idling speed of the engine at a target idling speed and a feedback control for an air-fuel ratio of a fuel mixture in the engine is also performed in accordance with an output of an air-fuel ratio sensor, in which an improper learning operation for renewing the learning control correction value is prevented from being conducted in the feedback control for the controllable factor to vary speed of the engine when the air-fuel ratio sensor is in malfunction.

According to the present invention, there is provided a control system for an internal combustion engine comprising an engine speed sensor for detecting speed of the engine, a feedback correction value producing section for producing a feedback correction value relating to a controllable factor for varying the speed of the engine in accordance with a difference between the speed of the engine detected by the engine speed sensor and a target idling speed when the engine is in an idle operation satisfying predetermined conditions, a learning control correction value producing section for producing a learning control correction value based on the feedback correction value and storing the learning control correction value in a memory to renew a stored learning control correction value, an engine speed controlling section for performing a feedback control for the controllable factor with the feedback correction value and the learning control correction value combined with a fundamental control value so as to keep an actual idling speed of the engine substantially at the target idling speed, an air-fuel ratio sensor disposed in an exhaust passage of the engine for detecting an air-fuel ratio of a fuel mixture in the engine, an air-fuel ratio control section for performing a feedback control for the air-fuel ratio of the fuel mixture in accordance with a detection output of the air-fuel ratio sensor, a malfunction detecting section for detecting malfunction of the air-fuel ratio sensor based on the detection output of the air-fuel ratio sensor, and a learning operation prohibiting section for prohibiting the learning control correction value producing section from producing a new learning control correction value when the malfunction of the air-fuel ratio sensor is detected by the malfunction detecting section.

In the control system for an internal combustion engine thus constituted in accordance with the present invention, since the learning control correction value producing section is prohibited from producing newly the learning control correction value by the learning operation prohibiting section when the malfunction of the air-fuel ratio sensor is detected by the malfunction detecting section, an improper learning operation for renewing the learning control correction value stored in the memory is forbidden and therefore an idling speed control by the engine speed controlling section is surely prevented from being conducted undesirably with an improper learning control correction value.

The above, and other objects, features and advantages of the present invention will become apparent from the following detailed description which is to be read in conjunction with the accompanying drawings.

DESCRIPTION OF THE PREFERRED EMBODIMENT

The invention will now be described by way of example with reference to the accompanying drawings.

Figure 1:
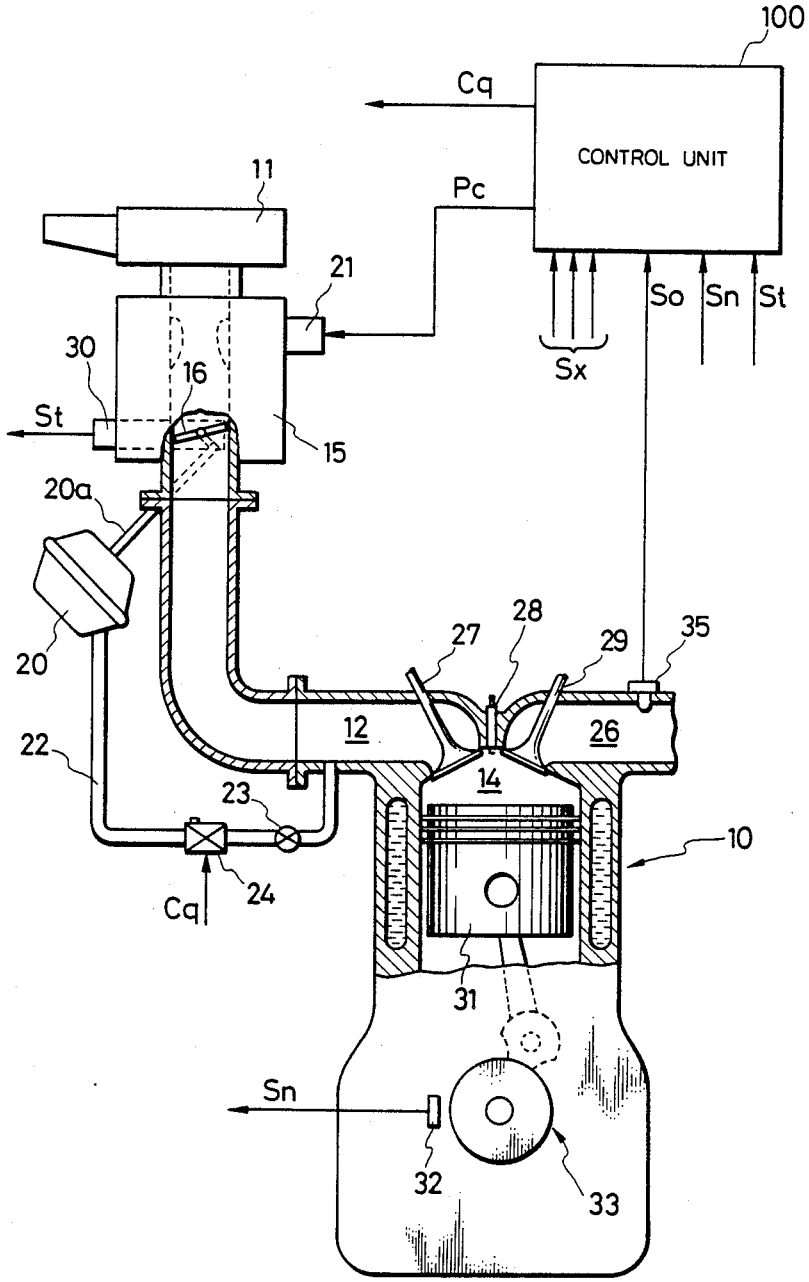
FIG. 1 is a schematic illustration showing one embodiment of control system for an internal combustion engine according to the present invention, together with a principal part of an internal combustion engine to which the embodiment is applied.

Referring to FIG. 1, an embodiment of control system according to the present invention is applied to an internal combustion engine which is mounted on a vehicle and has an engine body 10. The engine body 10 is provided with an inlet passage 12 and an exhaust passage 26. An air flow introduced through an air cleaner 11 into the inlet passage 12 is supplied through a throttle valve 16 in a carburetor 15 mounted on the inlet passage 12 to a combustion chamber 14 in the engine body 10. The carburetor 15 is of the type well known and provided with an air-fuel ratio control valve 21 comprising a solenoid valve closed normally. The air-fuel ratio control valve 21 is opened in accordance with the pulse width of a driving pulse signal Pc derived from a control unit 100 and operative to control quantity of fuel supplied to the inlet passage 12.

The throttle valve 16 has its opening degree varying in proportion to controlled variable on an accelerator pedal when the accelerator pedal is controlled and further is able to be opened by a diaphragm device 20 when the accelerator pedal is not controlled. The diaphragm device 20 is operative to pull a driving rod 20*a* therein so as to open the throttle valve 16 when a negative pressure is applied to the diaphragm device 20 through a pipe 22 from a portion of the inlet passage 12 between the throttle valve 16 and the engine body 10. The pipe 22 is provided thereon with an adjusting valve 23 for regulating the negative pressure applied therethrough to the diaphragm device 20 and a solenoid valve 24 operative to be opened in accordance with the pulse width of a driving pulse signal Cq derived from the control unit 100. The solenoid valve 24 is provided with a solenoid to which the driving pulse signal Cq is applied and operative to open the pipe 22 when the solenoid is energized by the driving pulse signal Cq and to close the pipe 22 when the solenoid is not energized.

A fuel mixture produced by the carburetor 15 is supplied through an intake valve 27 to the combustion chamber 14 and ignited by a spark plug 28 to burn thereat. From the combustion chamber 14, exhaust gas is guided through an exhaust valve 29 into the exhaust passage 26.

An oxygen sensor 35 which acts as an air-fuel ratio sensor is attached to the exhaust passage 26 and a detection output signal So of the oxygen sensor 35 is supplied to the control unit 100. The detection output signal So is a signal of voltage varying, for example, in the range of 0 to 1 volts and has a reference level Vs, for example, 0.45 volts when the air-fuel ratio of the fuel mixture detected by the oxygen sensor 35 is equal to the stoichiometric air-fuel ratio, a level lower than the reference level when the air-fuel ratio of the fuel mixture detected by the oxygen sensor 35 is larger than the stoichiometric air-fuel ratio, that is, the fuel mixture is lean, and a level higher than the reference level when the air-fuel ratio of the fuel mixture detected by the oxygen sensor 35 is smaller than the stoichiometric air-fuel ratio, that is, the fuel mixture is rich.

An engine speed sensor 32 is provided in relation to a crank mechanism 33 for converting the reciprocating movement of a piston 31 into the rotary movement of a crank shaft and a detection output signal Sn varying in response to speed of the engine is supplied from the engine speed sensor 32 to the control unit 100. Further, a detection output signal St obtained from a throttle opening degree sensor 30 to represent opening degree of the throttle valve 16 and other detection output signals Sx necessary for controlling the engine, such as a detection output signal obtained from a coolant temperature gauge mounted on the engine body 10, are also supplied to the control unit 100.

The control unit 100 is operative to produce the driving pulse signal Pc based on the detection output signals mentioned above and supply the same to the air-fuel ratio control valve 21 for controlling the quantity of fuel supplied to the inlet passage 12 so as to control the air-fuel ratio of the fuel mixture supplied to the combustion chamber 14, and operative also to produce the driving pulse signal Cq and supply the same to the solenoid valve 24 so as to control intake air mass flow in the inlet passage 12.

In the control of the air-fuel ratio of the fuel mixture, the control unit 100 sets a control value Cfb for determining opening degree of the air-fuel ratio control valve 21, and checks whether the operation of the engine meets predetermined conditions for a feedback control for the air-fuel ratio of the fuel mixture or not, based on the detection output signals St, Sn and Sx. If the operation of the engine does not meet the predetermined conditions for the feedback control, the control unit 100 causes the control value Cfb to be a reference value $C_1$ and produces the driving pulse signal Pc having its pulse width corresponding to the referenced value $C_1$ to be supplied to the air-fuel ratio control valve 21. The air-fuel ratio control valve 21 is driven to open at a predetermined period, for example, at every 1/20 seconds by the driving pulse signal Pc to vary the quantity of fuel supplied to the inlet passage 12, and an open-loop control for the air-fuel ratio of the fuel mixture supplied to the combustion chamber 14 is performed. In such a case, the reference value $C_1$ is predetermined so as to cause the driving pulse signal Pc to have its pulse duty factor of a percent value selected from, for example, the range of 0 to 40% in accordance with the speed of the engine, load with which the engine works, temperature of coolant in the engine and other variables.

Figure 2A:
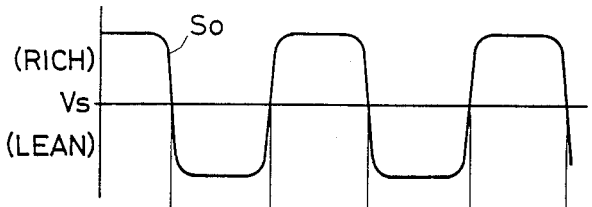
FIGS. 2A and 2B are characteristic diagrams used for explaining the operation of the embodiment shown in FIG. 1.
Figure 2B:
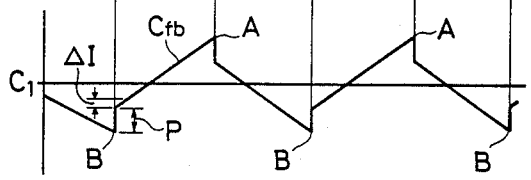

On the other hand, if the operation of the engine meets the predetermined conditions for the feedback control, the control unit 100 causes the control value Cfb to be a value corresponding to the level of the detection output signal So from the oxygen sensor 35 and produces the driving pulse signal Pc having its pulse width corresponding to the control value Cfb to be supplied to the air-fuel ratio control valve 21. In such a case, when the detection output signal So varies as shown in FIG. 2A, the control value Cfb has a peak A whenever the detection output signal So crosses the reference level Vs from low to high and a bottom B whenever the detection output signal So crosses the reference level Vs from high to low, as shown in FIG. 2B. The control value Cfb comprises a proportional part and a integrated part as previously known so as to decrease or increase by value P at the peak A or bottom B and then gradually decrease or increase by a small value ΔI a time. With such variations of the control value Cfb, the opening degree of the air-fuel ratio control valve 21 is varied to control the quantity of fuel supplied to the inlet passage 12 and a feedback control for the air-fuel ratio of the fuel mixture supplied to the combustion chamber 14 is performed so that the air-fuel ratio of the fuel mixture is caused to take a value in a relatively narrow range including the value of the stoichiometric air-fuel ratio.

Under the feedback control for the air-fuel ratio of the fuel mixture carried out as mentioned above, when the oxygen sensor 35 comes to be in malfunction due to breaking of wire, short-circuit or temporary inertness resulting from low temperature, and thereby the detection output signal So has the level thereof which does not reach the reference level Vs, the control unit 100 detects the malfunction of the oxygen sensor 35 based on the detection output signal So and causes the control value Cfb to be a fixed value Ca which is predetermined so as to cause the driving pulse signal Pc to have its pulse duty factor of, for example, 30% and thereby to make the fuel mixture rich.

Supposing that the control value Cfb is not caused to be the fixed value Ca when the oxygen sensor 35 comes to be in malfunction, since the level of the detection output signal So does not reach the reference level Vs, the control unit 100 misunderstands that the fuel mixture provided for combustion in the combustion chamber 14 is lean and therefore operates to make the control value Cfb large so as to increase the quantity of fuel supplied to the inlet passage 12. This results in that the quantity of fuel supplied to the inlet passage 12 is increased excessively and the fuel mixture provided for combustion becomes too rich.

Further, in the control of the intake air mass flow in the inlet passage 12, the control unit 100 checks whether the operation of the engine meets predetermined conditions for a feedback control for the intake sir mass flow or not, based on the detection output signals St, Sn and Sx. The predetermined conditions for the feedback control includes, for example, a condition that the throttle valve 16 is fully closed, a condition that the speed of the engine is less than a predetermined speed which is set to be, for example, 300 to 700 rpm higher than a target idling speed TN which has a value selected from, for example, the range of 600 to 950 rpm in accordance with the type of a transmission coupled with the engine, the existence of an air conditioner driven by the engine and other load with which the engine works, and a condition that the temperature of the coolant in the engine is higher than a predetermined value Ta, for example, 67° C. If the operation of the engine meets the predetermined conditions for the feedback control, the control unit 100 sets a fundamental control value DB based on variables indicating the operating condition of the engine, such as the temperature of the coolant represented by the detection output signal Sx, and produces a feedback correction value DF in accordance with a difference ΔN between an actual engine speed N represented by the detection output signal Sn and the target idling speed TN. Further, when the operation of the engine meets predetermined learning conditions including a condition that the temperature of the coolant is higher than a predetermined value Tb, for example, 80° C. which is higher than the above mentioned predetermined value Ta, the control unit 100 calculates a learning control correction value DL based on the feedback correction value DF and stores the calculated learning control correction value DL in a memory contained therein to renew the learning control correction value DL stored in the memory.

Then, the control unit 100 sets a final control value D by summing up the fundamental control value DB, the feedback correction value DF and the learning control correction value DL stored in the memory, and produces the driving pulse signal Cq having its pulse width corresponding to the final control value D to be supplied to the solenoid valve 24. The solenoid valve 24 is opened for a period of time corresponding to the final control value D to vary the negative pressure supplied to the diaphragm device 20 and thereby the opening degree of the throttle valve 16 is adjusted. Consequently, the feedback control for the intake air mass flow is performed so that the actual engine speed N is kept at the target idling speed TN.

When the operation of the engine does not meet the predetermined conditions for the feedback control, the control unit 100 causes the feedback correction value DF to be a referenced value $D_1$, and sets the final control value D by summing up the fundamental control value DB set in such a manner as mentioned above, the feedback correction value DF set to be the reference value $D_1$, and the learning control correction value DL stored in the memory, and produces the driving pulse signal Cq having its pulse width corresponding to the final control value D to be supplied to the solenoid valve 24. As a result, an open-loop control for the intake air mass flow is performed.

In the situation where the feedback control for the air-fuel ratio of the fuel mixture and the feedback control for the intake air mass flow are carried out respectively as described above, when the oxygen sensor 35 comes to be in malfunction, the control unit 100 detects the malfunction of the oxygen sensor 35 based on the detection output signal So and ceases setting newly the learning control correction value DL so that the feedback control for the intake air mass flow is performed continuously with use of the learning control correction value DL stored in the memory before the malfunction of the oxygen sensor 35 is detected. Accordingly, an improper learning operation for renewing the learning control correction value DL stored in the memory is forbidden and the idling speed control is surely prevented from being conducted undesirably through the feedback control for the intake air mass flow carried out with final control value containing an improper learning control correction value.

The control unit 100 provided in the embodiment shown in FIG. 1 may be composed of a microcomputer. Examples of operation programs of such a microcomputer for controlling the air-fuel ratio control valve 21 and the solenoid valve 24 respectively in such a manner described above are carried out in accordance with flow charts shown in FIGS. 3 and 4.

Figure 3:
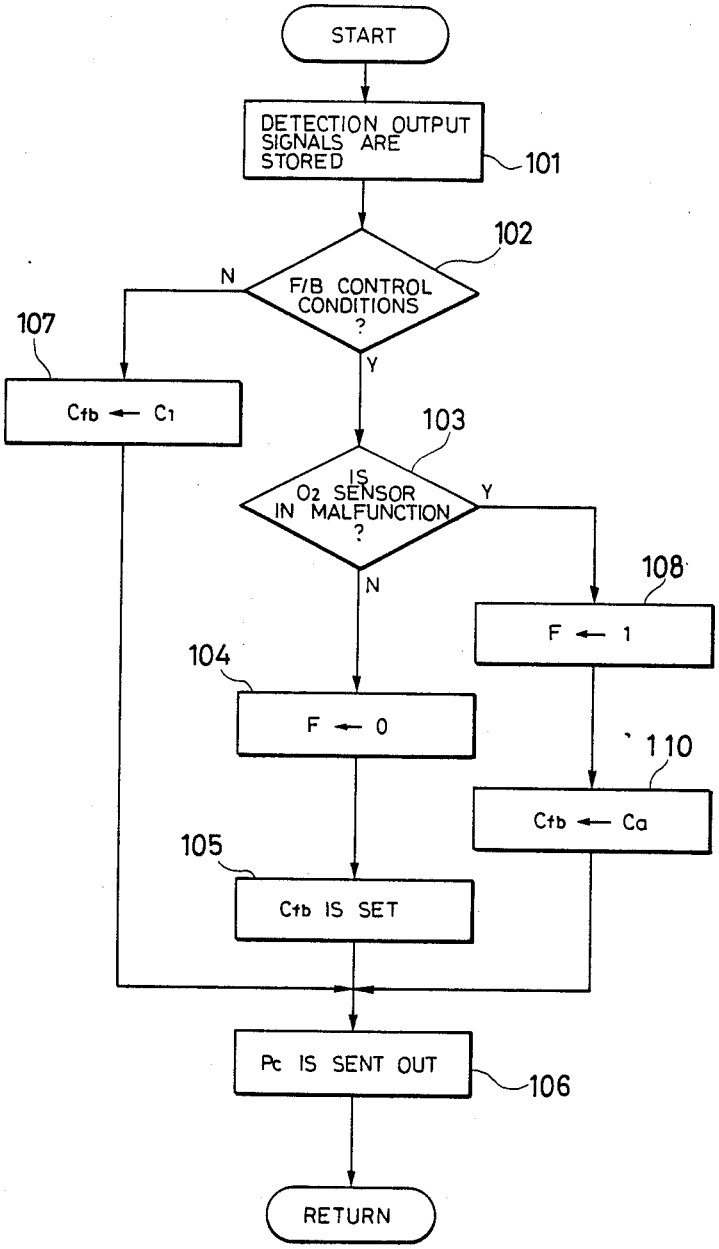
FIGS. 3 and 4 are flow charts showing an example of an operation program for a microcomputer used in a control unit employed in the embodiment shown in FIG. 1.

According to the flow chart shown in FIG. 3 for the control of the air-fuel ratio control valve 21, first, in process 101, the detection output signals St, Sn, So and Sx are stored. Then, in decision 102, it is checked whether the operation of the engine meets the predetermined conditions for the feedback (F/B) control or not based on the detection output signals St, Sn and Sx. In the case where the operation of the engine meets the predetermined conditions for the feedback control, it is further checked whether the oxygen sensor 35 is in malfunction or not, in decision 103. This check is achieved by checking whether a period of time Tz in which the level of the detection output signal So is lower than the reference level Vs (FIG. 5A) is longer than a predetermined reference period of time $T_1$ (FIG. 5A) or not. For example, the reference period of time $T_1$ is set to be 20 seconds when a period of time Ty wherein the level of the detection output signal So is continuously higher than the reference level Vs immediately before the period of time Tz (FIG. 5A) is shorter than 1.25 seconds, 16×[the length of the period of time Ty] seconds when the period of time Ty is equal to or longer than 1.25 second but shorter than 2.5 seconds, and 40 seconds when the period of time Ty is equal to or longer than 2.5 seconds. When it is clarified that the oxygen sensor 35 is not in malfunction, a flag F for malfunction is set to be "0", in process 104. Then, the control value Cfb is set in such a manner as aforementioned with reference to FIGS. 2A and 2B, in process 105, and the step advances to process 106.

On the other hand, when it is clarified that the operation of the engine does not meet the predetermined conditions for the feedback control, in the decision 102, the control value Cfb is set to be the reference value $C_1$, in process 107 and the step advances to the process 106. Further, when it is clarified that the oxygen sensor 35 is in malfunction, in the decision 103, the flag F for malfunction is set to be "1" in process 108, then the control value Cfb is set to be the fixed value Ca in process 110 and the step advances to the process 106. In the process 106, the driving pulse signal Pc having its pulse width corresponding to the control value Cfb is produced to be sent out to the air-fuel ratio control valve 21, and the step returns to the process 101.

Figure 4:
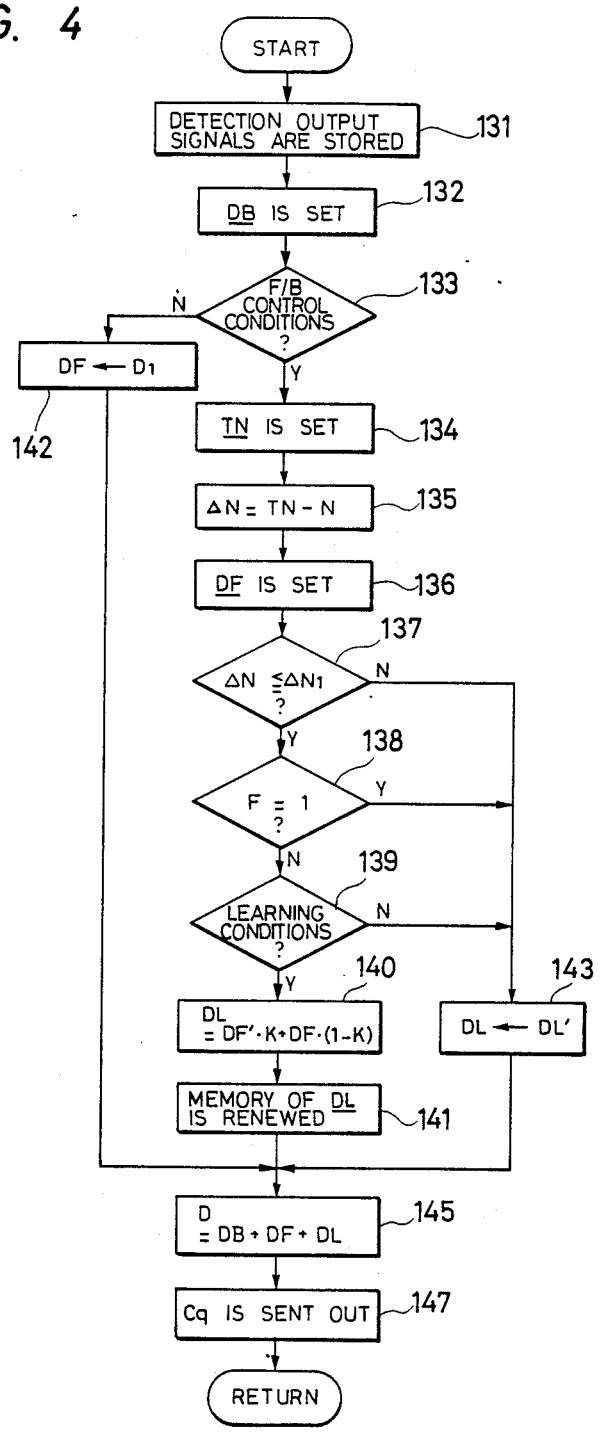

According to the flow chart shown in FIG. 4 for the control of the solenoid valve 24, first, in process 131, the detection output signals St, Sn and Sx are stored. Then, in decision 132, the fundamental control value DB is determined based on the detection output signals Sx and the step advances to decision 133. In the decision 133, it is checked whether the operation of the engine meets the predetermined conditions for the feedback control or not based on the detection output signals St, Sn and Sx. When the operation of the engine does not meet the predetermined conditions for the feedback control, the feedback correction value DF is set to be the reference value $D_1$ in process 142 and the step advances to process 145. To the contrary, when the operation of the engine meets the predetermined conditions for the feedback control, the target idling speed TN is determined based on the detection output signals Sx in process 134 and the step advances to process 135.

In the process 135, the difference ΔN between the actual engine speed N represented by the detection output signal Sn and the target idling speed TN determined in the process 134 is calculated by subtracting the actual engine speed N from the target idling speed TN, and the feedback correction value DF is set in accordance with the difference ΔN, in process 136. Then, in decision 137, it is checked whether the difference ΔN is less than a predetermined small value $\Delta N_1$ or not. This check is conducted for judging whether the actual engine speed N has a value in a relatively narrow range including the target idling speed TN or not. When the difference ΔN is less than the predetermined small value $\Delta N_1$, that is, the actual engine speed N has a value in the relatively narrow range including the target idling speed TN, it is checked whether the flag F for malfunction, which is set in the control of the air-fuel ratio control valve 21 carried out in accordance with the flow chart shown in FIG. 3, is "1" or not in decision 138. If the flag F is not "1", it is checked whether the operation of the engine meets the learning conditions or not in decision 139. As a result, when it is clarified that the operation of the engine meets the learning conditions, the learning control correction value DL is calculated in accordance with the following equation, in process 140:

$$DL = DF' \cdot k + DF \cdot (1-k),$$

where DF' is the feedback correction value having been previously set and k is a constant smaller than "1". That is, the learning control correction value DL is obtained by calculating a weighted summation of the feedback correction value DF' and the feedback correction value DF, which are set successively in the process 136. The learning control correction value DL thus calculated in the process 140 is stored in the memory so as to renew the feedback correction value DL' stored previously in the memory, in process 141, and the step advances to the process 145.

In the case where the difference ΔN is not less than the predetermined small value $\Delta N_1$, that is, the actual engine speed N does not have the value in the relatively narrow range including the target idling speed TN as a result of the check in the decision 137, the learning control correction value DL' stored previously in the memory is used as the learning control correction value DL on that occasion without calculating any new learning control correction value DL, in process 143, and the step advances to the process 145. Further, when it is clarified that the flag F is "1" in the decision 138 or when it is clarified that the operation of the engine does not meet the learning conditions in the decision 139, the step advances also to the process 145. Accordingly, the learning control correction value DL is not newly calculated in the situation in which the oxygen sensor 35 is in malfunction or the situation in which the operation of the engine does not meet the learning conditions.

In the process 145, the final control value D is calculated by summing up the fundamental control value DB, the feedback correction value DF and the learning control correction value DL. Then, the driving pulse signal Cq having its pulse width corresponding too the final control value D is produced and sent out to the solenoid valve 24, in process 147, and the step returns to the process 131.

Figure 5A:
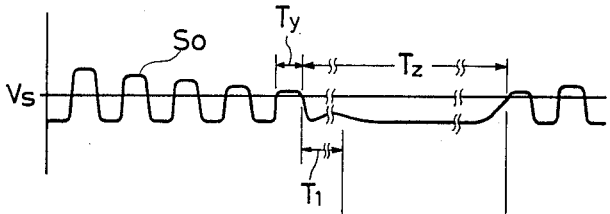
FIGS. 5A to 5E are time charts used for explaining the operation of the embodiment shown in FIG. 1.
Figure 5B:
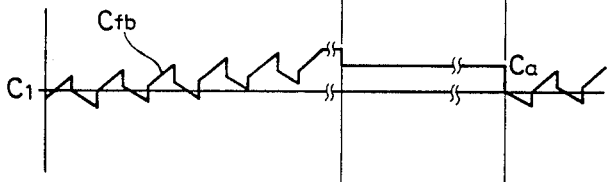

Under the controls of the air-fuel ratio control valve 21 and the solenoid valve 24 carried out in accordance with the flow charts shown FIGS. 3 and 4 as described above, in the case where the engine is caused to keep the idle operation for a relatively long time and therefore the temperature of the exhaust gas from the engine decreases gradually, each of intermittent periods of time in which the level of the detection output signal So obtained from the oxygen sensor 35 is equal to or higher than the reference level Vs decreases gradually and the level of the detection output signal So comes to be lower than the reference level Vs though the operation of the engine meets the predetermined conditions for the feedback control, as shown in FIG. 5A. With the level of the detection output signal So varying in such a manner as shown in FIG. 5A, the control unit 100 misunderstands that the fuel mixture supplied to the combustion chamber 14 is lean and therefore operates to make the control value Cfb vary as shown in FIG. 5B so as to increase the quantity of fuel supplied to the inlet passage 12 when each of the intermittent periods of time in which the level of the detection output signal So is equal to or higher than the reference level Vs decreases gradually. Then, after a time point $t_1$ at which the period of time Tz in which the level of the detection output signal So is continuously lower than the reference level Vs has reached the predetermined reference period of time $T_1$, the control unit 100 causes the control value Cfb to keep the fixed value Ca up to a time point $t_2$ at which the level of the detection output signal So recovers to be higher than the reference level Vs.

Figure 5C:
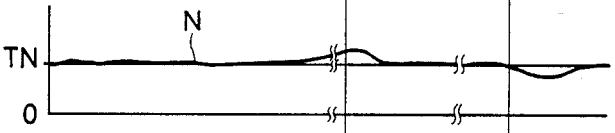
Figure 5D:
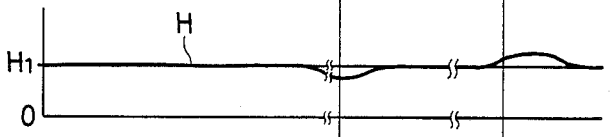

When the quantity of fuel supplied to the inlet passage 12 is thus controlled with the control value Cfb varied as shown in FIG. 5B, the actual engine speed N deviates from the target idling speed TN in a relatively short period of time including the time point $t_1$ and a relatively short period of time immediately after the time point $t_2$, as shown in FIG. 5C. However, on such occasions, since the feedback correction value DF is obtained in accordance with the difference ΔN between the actual engine speed N and the target idling speed TN and the pulse width of the driving pulse signal Cq supplied to the solenoid valve 24 is varied in response to the feedback correction value DF, opening degree H of the throttle valve 16 is decreased a little compared with a reference value $H_1$, which is taken under the situation in which the actual engine speed N is kept at the target idling speed TN, during the relatively short period of time including the time point $t_1$ and increased a little compared with the reference value $H_1$ during the relatively short period of time immediately after the time point $t_2$, as shown in FIG. 5D, so as to adjust the intake air mass flow in the inlet passage 12. Accordingly, the deviations of the actual engine speed N from the target idling speed TN arising in the relatively short period of time including the time point $t_1$ and the relatively short period of time immediately after the time point $t_2$, respectively, are restricted to be small.

Figure 5E:
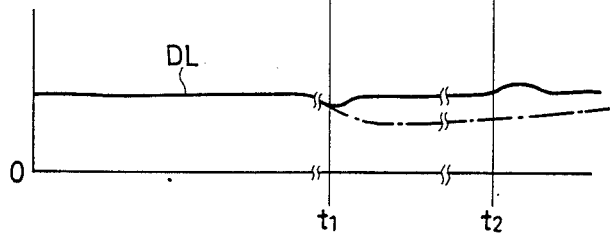

In the meantime, if the calculation of the learning control correction value DL were conducted in accordance with the equation $DL = DF' \cdot k + DF \cdot (1-k)$ for renewing the learning control correction value DL stored in the memory during a period of time from the time point $t_1$ to the time point $t_2$, the learning control correction value DL is reduced by a relatively large margin in the period of time from the time point $t_1$ to the time point $t_2$, as indicated by a dot-dash line in FIG. 5E. Under the situation in which the learning control correction value DL is thus reduced, due to the malfunction of the oxygen sensor 35, when the engine is caused to work in an operation mode other than an idle operation mode, the temperature of the exhaust gas from the engine rises and therefore the oxygen sensor 35 recovers to produce the detection output signal So having a proper level. However, the learning control correction value DL is not renewed during the operation mode other than the idle operation mode of the engine Therefore, when the operation of the engine is shifted to the idle operation again, the feedback control for the intake air mass flow is commenced with the learning control correction value DL which was reduced and stored in the memory in the period of time from the time point $t_1$ to the time point $t_2$, so that a problem that a relatively long time is necessitated to cause the actual engine speed N to coincide with the target idling speed TN.

Accordingly, in the embodiment shown in FIG. 1, the calculation and renewal of the learning control correction value DL are forbidden when the oxygen sensor 35 is in malfunction, so that the learning control correction value DL is kept to be almost equal to a value taken under the condition in which the oxygen sensor 35 operates normally during the period of time from the time point $t_1$ to the time point $t_2$, as indicated by a solid line in FIG. 5E, and therefore the above mentioned problem is prevented from arising.

Figure 6:
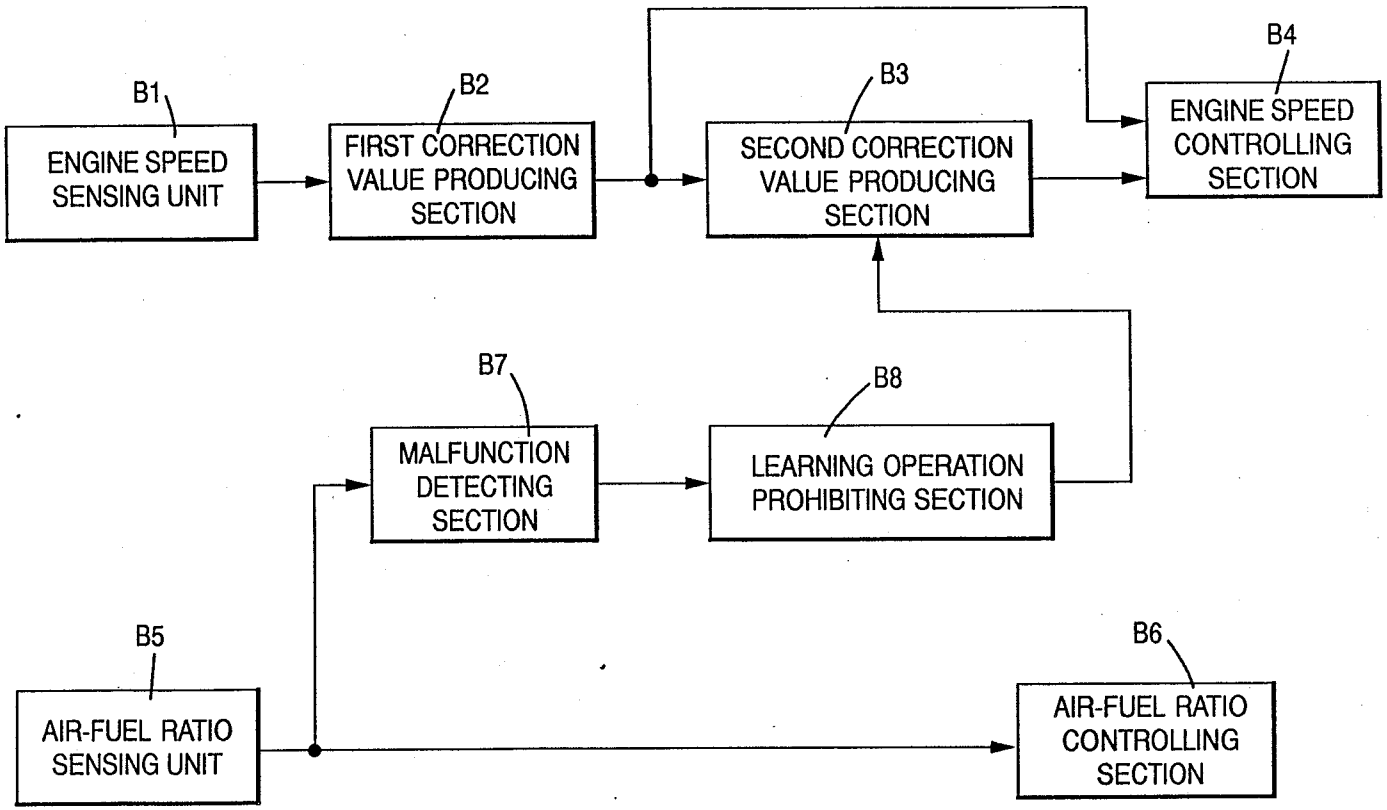
FIG. 6 is a block diagram illustrating the basic arrangement of a control system for an internal combustion engine according to the present invention.

FIG. 6 illustrates a block diagram showing the fundamental configuration of a control system according to the present invention. In the block diagram of FIG. 6, the system comprises, as described in the aforementioned summary, an engine speed sensing unit B1, a first correction value producing section B2, a second correction value producing section B3, an engine speed controlling section B4, an air-fuel ratio sensing unit B5, an air-fuel ratio controlling section B6, a malfunction detecting section B7 and a learning operation prohibiting section B8.

The engine speed sensing unit B1 is operative to detect speed of an internal combustion engine to which the control system is applied. The first correction value producing section B2 produces, in accordance with a difference between the speed of the engine detected by the engine speed sensing unit B1 and a target idling speed, a feedback correction value in relation to a controllable factor for varying the speed of the engine when the engine is in a predetermined idling operation. The second correction value producing section B3 produces a learning control correction value, based on the feedback correction value obtained from the first correction value producing section B2, and stores the learning control correction value in a memory to renew a stored learning control correction value in the memory. The engine speed controlling unit B4 is operative to perform a feedback control for the controllable factor for varying the speed of the engine with the feedback correction value obtained from the first correction value producing section B2 and the stored learning control correction value obtained from the second correction value producing section B3, whereby an actual idling speed of the engine is maintained substantially at the target idling speed. The air-fuel ratio sensing unit B5 is disposed in an exhaust passage of the engine and operative to produce a detection output signal varying in response to an air-fuel ratio of a fuel mixture in the engine. The air-fuel ratio controlling unit B6 is operative to perform a feedback control for the air-fuel ratio of the fuel mixture in the engine in accordance with the detection output of the air-fuel ratio sensing unit B5. The malfunction detecting section B7 is operative to detect malfunction of the air-fuel ratio sensing unit B5. The learning operation prohibiting section B8 is operative to prohibit the second correction value producing section B3 from renewing the stored learning control correction value when the malfunction of the air-fuel ratio sensing unit B5 is detected by the malfunction detecting section B7.

What is claimed is:

1. A control system for an internal combustion engine comprising:

engine speed sensing means for detecting speed of the engine, first correction value producing means for producing a feedback correction value which controls a controllable factor for varying the speed of the engine in accordance with a difference between the speed of the engine detected by said engine speed sensing means and a target idling speed when the engine is in an idle operation satisfying predetermined conditions, second correction value producing means for producing a learning control correction value based on the feedback correction value produced by said first correction value producing means and storing said learning control correction value in a memory to renew a stored learning control correction value, engine speed controlling means for performing a feedback control for said controllable factor with said feedback correction value and said stored learning control correction value combined with a fundamental control value so as to keep an actual idling speed of the engine substantially at said target idling speed, air-fuel ratio sensing means disposed in an exhaust passage of the engine for producing a detection output varying in response to an air-fuel ratio of a fuel mixture in the engine, air-fuel ratio control means for performing a feedback control for the air-fuel ratio of the fuel mixture in accordance with the detection output of said air-fuel ratio sensing means, malfunction detecting means for detecting malfunction of said air-fuel sensing means based on the detection output of the air-fuel ratio sensing means, and learning operation prohibiting means for prohibiting said second correction value producing means from renewing the stored learning control correction value when the malfunction of the air-fuel ratio sensing means is detected by said malfunction detecting means such that said engine speed controlling means continues to perform said feedback control without the stored learning control correction value being renewed.

2. A control system for an internal combustion engine according to claim 1, wherein said controllable factor for varying the speed of the engine is selected to be intake air mass flow in an inlet passage of the engine.

3. A control system for an internal combustion engine according to claim 1, wherein said first correction value producing means is operative to produce said feedback correction value when the engine is in the idle operation with a throttle valve in a normally closed condition.

4. A control system for an internal combustion engine according to claim 1, wherein said first correction value producing means is operative further to cause said feedback correction value to be a reference value when the operation of the engine does not meet said predetermined conditions and said engine speed controlling means is operative further to perform an open-loop control for said controllable factor with said feedback correction value and said learning control correction value combined with the fundamental control value when said first correction value producing means causes said feedback correction value to be the reference value.

5. A control system for an internal combustion engine according to claim 1, wherein said second correction value producing means is operative to produce said learning control correction value by calculating a weighted summation of two feedback correction values successively produced by said first correction value producing means.

6. A control system for an internal combustion engine according to claim 1, wherein said learning operation prohibiting means is operative further to prohibit said second correction value producing means from producing a new learning control correction value when the difference between the speed of the engine and the target idling speed is larger than a predetermined value.

7. A control system for an internal combustion engine according to claim 1, wherein said air-fuel ratio control means is operative further to perform a open-loop control for the air-fuel ratio of the fuel mixture with a fixed control value when the malfunction of the air-fuel ratio sensing means is detected by said malfunction detecting means.

8. A control system for an internal combustion engine according to claim 1, wherein said air-fuel ratio sensing means is operative to produce, as the detection output, a signal which has a level variation coming to be higher than a reference level and lower than the reference level alternately for indicating a rich fuel mixture and a lean fuel mixture under a normally operating condition.

9. A control system for an internal combustion engine according to claim 8, wherein said malfunction detecting means is operative to detect the malfunction of said air-fuel ratio sensing means when a period of time in which said level variation of the signal produced by said air-fuel ratio sensing means does not arise exceeds a predetermined reference period of time.

10. A control system for an internal combustion engine according to claim 9, wherein said malfunction detecting means is operative further to detect a normal operation of said air-fuel ratio sensing means when said level variation of the signal produced by said air-fuel ratio sensing means arises after said period of time in which said level variation does not arise has passed.

11. A control system for an internal combustion engine according to claim 9, wherein said predetermined reference period of time is set in accordance with a period of time in which a level of said signal produced by the air-fuel ratio sensing means exceeds continuously said reference level.

12. A control system for an internal combustion engine according to claim 11, wherein said predetermined reference period of time is set to be in proportion to said period of time in which the level of said signal produced by the air-fuel ratio sensing means exceeds continuously said reference level.

* * * * *